US007160851B2

(12) United States Patent
Goodacre et al.

(10) Patent No.: US 7,160,851 B2
(45) Date of Patent: Jan. 9, 2007

(54) PERFUME COMPOSITIONS

(75) Inventors: Terence Goodacre, High Halden (GB); Keith Douglas Perring, Ashford (GB)

(73) Assignee: Quest International Services B.V., Naarden (NL)

( * ) Notice: Subject to any disclaimer, the term of this patent is extended or adjusted under 35 U.S.C. 154(b) by 0 days.

(21) Appl. No.: 10/474,133

(22) PCT Filed: Apr. 4, 2002

(86) PCT No.: PCT/GB02/01609

§ 371 (c)(1),
(2), (4) Date: Oct. 6, 2003

(87) PCT Pub. No.: WO02/081614

PCT Pub. Date: Oct. 17, 2002

(65) Prior Publication Data

US 2004/0116325 A1 Jun. 17, 2004

(30) Foreign Application Priority Data

Apr. 6, 2001 (GB) ..... 0108657.8

(51) Int. Cl.
*C11D 3/50* (2006.01)
*A61Q 13/00* (2006.01)

(52) U.S. Cl. ..... 512/6; 424/65; 510/101

(58) Field of Classification Search ..... 512/6; 424/65; 510/101
See application file for complete search history.

(56) References Cited

U.S. PATENT DOCUMENTS

| | | | | | |
|---|---|---|---|---|---|
| 3,960,923 | A | * | 6/1976 | DeSimone | 558/373 |
| 4,576,742 | A | * | 3/1986 | Sprecker et al. | 510/105 |
| 5,105,005 | A | * | 4/1992 | Hopp et al. | 558/462 |
| 5,888,962 | A | * | 3/1999 | Frank et al. | 512/22 |
| 6,001,789 | A | | 12/1999 | Trinh et al. | |
| 6,024,943 | A | | 2/2000 | Ness et al. | |
| 6,086,903 | A | | 7/2000 | Trinh et al. | |

FOREIGN PATENT DOCUMENTS

| | | |
|---|---|---|
| WO | WO 93 04158 A | 3/1993 |
| WO | WO 99 00025 A | 1/1999 |

* cited by examiner

*Primary Examiner*—Monique T. Cole
(74) *Attorney, Agent, or Firm*—Morgan Lewis & Bockius LLP

(57) ABSTRACT

This invention is concerned with perfume compositions comprising: a) nitrile perfumery material of general formula RCN where R is a hydrocarbyl radical of formula CxHy, x is an integer in the range 9 to 12, and y is an integer in the range 15 to 25; and b) hydrocarbon perfumery material having a boiling point of less than about 185° C. and an octanol-water partition coefficient of at least 4.0 (in logarithmic form), wherein a) and b) together comprise at least 20% by weight of the total weight of the composition. Perfume compositions in accordance with the present invention provide a good deodorant effect several hours after application to a surface such as fabric or skin.

15 Claims, No Drawings

PERFUME COMPOSITIONS

This application is a 371 national phase filing of PCT/GB02/01609, filed Apr. 4, 2002 and claims priority benefit from said PCT application and GB Appln. No. 0108657.8, filed Apr. 6, 2001.

FIELD OF THE INVENTION

This invention relates to perfume compositions and to products containing such perfume compositions. The invention also concerns the use of perfume compositions to provide a deodorant effect.

BACKGROUND TO THE INVENTION

A highly desired attribute of many consumer products is that they include fragrances which demonstrate long-lasting effect e.g. following application to a surface. Several approaches have been used to deliver this property from a fragrance. These include, for example, the inclusion of a high boiling, low odour, fixative material to extend fragrance lifetime as described in U.S. Pat. No. 6,172,037, or the encapsulation of fragrance inside capsules which rupture or degrade following application to a surface as described in EP 0397246. Both of these approaches, however, may add to the cost of the fragrance and/or may result in a composition which is unsuitable for use in a variety of consumer products, possibly requiring further developmental work.

One alternative approach, as described in WO97/30689 and U.S. Pat. No. 5,500,154, lies in the formulation of perfumes that provide a long lasting aesthetic benefit with a minimum amount of material. These perfumes have been described as 'enduring perfumes'. Enduring perfumes comprise at least about 70% of perfume ingredients with relatively high boiling points (i.e. at least about 250° C.) and hydrophobicities (i.e. a ClogP of at least about 3.0). Such perfume compositions may however exhibit odour characteristics which are influenced by the odour properties of the substantial quantities of enduring perfume ingredients in the perfume compositions.

EP 0003172, EP 0005618, U.S. Pat. Nos. 4,304,679, 4,322,308, 4,278,658, 4,134,838, 4,288,341, 4,289,641 and 4,906,454 all describe perfume compositions which exhibit a deodorant action, either when applied to human skin using a cosmetically acceptable vehicle or when included in a detergent product or fabric conditioning product used in laundering of textiles. EP 0147191 and U.S. Pat. No. 4,663,068 describe deodorant perfume compositions which are stable in the presence of bleaching materials. A difficulty with these perfume compositions is that they generally include appreciable quantities of relatively high molecular weight perfume components which help to extend the effective lifetime of deodorant action following product application, but which tend to have less perfume impact and to exhibit odour characteristics which span a finite range.

The above described limitations of the perfume compositions of the prior art represent a compromise between long term deodorant efficacy and optimal hedonic performance. This compromise is particularly significant for perfumes characterised by "light notes" i.e. odour notes which are delicate, are not cloying and may in fact be fleeting, and dominated by what are known within the perfume industry as top-notes. By this is meant the odour notes which are detected during the first stages of perfume evaporation from a surface such as skin, and which typically, but not necessarily, tend to arise from volatile materials. Volatile materials will by their very nature evaporate faster than other perfume components and are not expected to contribute significantly to effective long term deodorant activity following application to surfaces such as skin or fabric.

The present invention concerns novel perfume compositions, particularly perfume compositions which may be described as light i.e. of delicate odour and non-enduring, yet demonstrate effective deodorant longevity.

SUMMARY OF THE INVENTION

In one aspect, the present invention provides a perfume composition comprising:

a) nitrile perfumery material of general formula RCN where R is a hydrocarbyl radical of formula CxHy, x is an integer in the range 9 to 12, and y is an integer in the range 15 to 25; and b) hydrocarbon perfumery material having a boiling point of less than about 185° C. and an octanol-water partition coefficient of at least 4.0 (in logarithmic form), wherein a) and b) together comprise at least 20% by weight of the total weight of the composition.

Nitriles are known perfumery materials for use in deodorant perfume compositions.

For example, EB 0299561 describes bleach compositions comprising peracid-stable perfume compositions. Composition B, Composition C and Composition D of the Examples respectively describe perfume compositions comprising 0.5% of dodecyl nitrile, 0.5% of 3-methyldodecanonitrile (FRESCILE™) and 0.5% of 2-methyldecanonitrile (FRUTONILE™).

WO 00/01361 describes deodorant perfume compositions prepared from at least three of six specified categories of perfume materials; hydroxylic materials, ketones, aldehydes, ethers, esters and nitrites.

EP 1113105 relates to malodour maskant compositions containing from about 10 to about 100% by weight of 3,7-dimethyl-2-6-octadien-1-nitrile (also known as CITRALVA™) and optional components, β-napthyl methyl ether, β-napthyl methyl ketone, benzyl acetone, CYCLAPROP™, gamma-methyl ionone, AMBERIFF™, the ethylene glycol cyclic ester of n-docecanedioic acid, 1-cyclohexadecen-6-one and/or 1-cycloheptadecene-10-one and corn mint oil.

However, it is well known to those skilled in the art of perfumery that it can be difficult to use nitriles, particularly unsaturated nitriles such as citronellyl nitrile and geranyl nitrile, at significant levels in a perfume as they tend to smother the odour perception of other ingredients. A difficulty with some of the perfume compositions disclosed in the prior art is that they may include such components which frequently give them strong, powerful odours which are difficult for the perfumer to blend out and which can limit the usefulness of the compositions when used to perfume some other product such as a detergent composition, fabric conditioner or personal care product. As discussed above, there is generally a necessity for compromise between deodorant efficacy and acceptability as a fragrance.

The nitrile perfumery material and hydrocarbon perfumery material of the perfume compositions defined herein may be categorised as top-notes, having generally low to moderate boiling points. The materials may also be described as light notes as they contribute delicate notes to the perfume composition which are not cloying and may in fact be fleeting.

It has been found by the inventors that the above defined perfume compositions characterised by the presence of an appreciable amount of top-note materials demonstrate unexpected high deodorant activity several hours after application. Despite the comparatively high proportion of top-note materials present, which are expected to have a relatively transient influence on body malodour perception, perfume compositions as defined herein exhibit significant deodorant activity several hours, typically at least 5 hours, after application to the body i.e. skin or to fabric. It has thus been found that perfume compositions in accordance with the present invention makes it possible to obtain good deodorant performance and widely acceptable fragrance.

The term 'perfumery material' is herein taken to represent materials that may be acceptably employed within fragrances to provide an odour contribution to the overall hedonic performance of the fragrance. Typically, such materials will be generally recognised as possessing odours in their own right, and will be relatively volatile, and characterised by molecular weights within the range of around 100 to 300 amu.

The concentration of perfumery materials referred to herein is relative to the total concentration of perfumery materials present in the composition and excludes, for example, the presence of any optional solvents or diluents etc.

The octanol-water partition coefficient (P) of a material i.e. the ratio of a material's equilibrium concentration in octanol and water, is well known in the literature as a measure of hydrophobicity and water solubility (see Hansch and Leo, Chemical Reviews, 526 to 616, (1971), 71; Hansch, Quinlan and Lawrence, J. Organic Chemistry, 347 to 350 (1968), 33). High partition coefficient values are more conveniently given in the form of their logarithm to the base 10, log P. While log P values can be measured experimentally i.e. directly, and measured log P data is available for many perfumes, log P values are most conveniently calculated or approximately estimated using mathematical algorithms. There are several recognized calculation or estimation methods available commercially and/or described in the literature (see for example A. Leo, Chem. Rev 93(4), 1281–1306, (1993), "Calculating log P oct from structures"). Generally these models correlate highly but may for specific materials produce log P values which differ in absolute terns (by up to 0.5 log units or even more). However, no one model is universally accepted as the most accurate across all compounds. This is particularly true for estimates on materials of high log P (say 4 or greater). In the present specification, log P values are obtained using the estimation software commercially available as 'LogP' from Toronto-based Advanced Chemistry Development Inc (ACD) which is well-known to the scientific community, and accepted as providing high-quality predictions of log P values. References to log P values thus mean values obtained using the ACD software.

Perfume compositions in accordance with the present invention preferably comprise at least 25%, more preferably at least 30%, and most preferably about 50% by total weight of the composition of nitrile perfumery material and hydrocarbon perfumery material (ingredients (a) and (b)) as described herein.

Typically, the weight ratio of nitrile perfumery material to hydrocarbon perfumery material is in the range 10:1 to 1:2. Particularly effective perfume compositions may be prepared when the weight ratio of nitrile perfumery material to hydrocarbon perfumery material is in the range 3:1 to 2:3.

The nitrile perfumery material suitable for use herein may be saturated or unsaturated, and conveniently, the hydrocarbon perfumery material is a terpene. Examples of suitable nitrile perfumery material of category (a) and hydrocarbon perfumery material of category (b) include the following:

TABLE 1

| Perfumery Material | Category |
|---|---|
| 2-Methyldecanenitrile | (a) |
| 3-(2,4-dimethylcyclohex-3-enylidene)propanenitrile | (a) |
| 3,7-Dimethyl-2,6-nonadienenitrile | (a) |
| Camphene | (b) |
| Citronellyl nitrile | (a) |
| p-Cymene | (b) |
| Dodecanenitrile | (a) |
| Geranyl nitrile | (a) |
| 2-tridecenenitrile | (a) |
| 2-undecenenitrile | (a) |
| 3-methyldodecanonitrile | (a) |
| Limonene | (b) |
| Myrcene | (b) |
| Pinenes* | (b) |
| Terpinenes** | (b) |
| Terpinolene | (b) |

*including alpha-and beta-isomers
**including alpha-, beta-, and gamma isomers

Preferred nitrile perfumery material of category (a) includes unsaturated nitrile perfumery material where when x is 9, y is 15 or 17; when x is 10, y is 17 or 19; when x is 11, y is 19 or 21 and when x is 12, y is 21 or 23. Thus, preferably, y is an integer in the range 15 to 23. A particularly preferred unsaturated nitrile perfumery material for use herein is geranyl nitrile where x is 9 and y is 15. A preferred component of the hydrocarbon perfumery material of category (b) include pinenes such as alpha-pinene and beta-pinene, or mixtures thereof.

In a preferred perfume composition herein, geranyl nitrile comprises at least 75% by weight of nitrile perfumery material and α-pinene and β-pinene, typically in a weight ratio of 2:1 to 1:2, comprise at least 75% by weight of hydrocarbon perfumery material.

Generally, perfume compositions as defined herein are non-enduring and conveniently comprise low quantities of high boiling and highly hydrophobic perfume materials. That is, they typically comprise less than 70%, preferably less than 60% and even more preferably less than 50% of perfumery materials having a boiling point of at least about 250° C. and an octanol-water partition coefficient of at least about 3.0 (in logarithmic form to base 10).

Typically, nitrile perfumery material, whether saturated or unsaturated, having at least 12 carbon atoms, will have a boiling point greater than 250° C. and an octanol-water partition coefficient greater than 3.0. Such nitrile perfumery materials may be classified as 'enduing perfumery materials', which if employed in a perfume composition as defined herein are present in amount of less than 30% by weight of the perfume composition.

In a further aspect, the present invention provide a perfume composition comprising:

a) nitrile perfumery material of general formula RCN where R is a hydrocarbyl radical of formula CxHy, x is an integer it the range 9 to 12, and y is an integer in the range of 15 to 25; and b) hydrocarbon perfumery material having a boiling point of less than about 185° C. and an octanol-water partition coefficient of at least 4.0 (in logarithmic form), wherein a) and b) together comprise at least 20% by weight of the total weight of the composition and wherein:

(i) the weight ratio of nitrile perfumery material to hydrocarbon perfumery material is in the range 10:1 and 1.2; and (ii) the perfume composition comprises less than 70% of perfumery materials having a boiling point of at least about 250° C. and an octanol-water partition coefficient of at least 3.0 (in logarithmic form).

In the simplest case, the perfume composition consists of nitrile perfumery material and hydrocarbon perfumery material as defined herein. The perfume composition may however optionally comprise further excipients such as one or more additional perfumery materials, which will be selected so as to be congruent with the olfactory characters of the nitrile perfumery material and hydrocarbon perfumery material and to produce a fragrance having desired odour properties to meet the criteria of consumer acceptability and desired hedonic direction.

Additional perfumery materials that can be included in the perfume composition include natural products such as extracts, essential oils, absolutes, resinoids, resins, concretes etc., but also synthetic materials such as alcohols, aldehydes, ketones, ethers, acids, esters, acetals, ketals, etc., including saturated and unsaturated compounds, aliphatic, carbocyclic, and heterocyclic compounds.

Such perfumery materials are mentioned, for example, in S. Arctander, Perfume and Flavour Chemicals (Montclair, N.J., 1969), in S. Arctander, Perfume and Flavour Materials of Natural Origin (Elizabeth, N.J., 1960) and in "Flavour and Fragrance Materials—1991", Allured Publishing Co. Wheaton, Ill. USA.

Examples of additional perfumery materials which may be present in the perfume compositions in accordance with the invention are: acetyl cedrene, 4-acetoxy-3-pentyltetrahydropyran, 4-acetyl-6-t-butyl-1,1-dimethylindane, available under the trademark "CELESTOLIDE", 5-acetyl-1,1,2,3,3,6-hexamethylindane, available under the trademark "PHANTOLIDE", 6-acetyl-1-isopropyl-2,3,3,5-tetramethylindane, available under the trademark "TRASEOLIDE", alpha-n-amylcinnamic aldehyde, amyl salicylate, aubepine, aubepine nitrile, aurantion, 2-t-butylcyclohexyl acetate, 2-t-butylcyclohexanol, 3-(p-t-butylphenyl)propanal, 4-t-butylcyclohexyl acetate, 4-t-butyl-3,5-dinitro-2,6-dimethyl acetophenone, 4-t-butylcyclohexanol, benzoin siam resinoids, benzyl acetate, benzyl propionate, benzyl salicylate, benzyl isoamyl ether, bergamot oil, bornyl acetate, butyl salicylate, carvacrol, cedar atlas oil, cedryl methyl ether, cedryl acetate, cinnamic alcohol, cinnamyl propionate, cis-3-hexenol, cis-3-hexenyl salicylate, citronella oil, citronellol, citronellyl acetate, citronellyloxyacetaldehyde, cloveleaf oil, coumarin, 9-decen-1-ol, n-decanal, n-dodecanal, decanol, decyl acetate, dihydromyrcenol, dihyronyrcenyl formate, dihydromyrcenyl acetate, dihydroterpinyl acetate, dimethylbenzyl carbinyl acetate, dimethylbenzylcarbinol, dimethylheptanol, dimethyloctanol, dimyrcetol, diphenyl oxide, ethyl naphthyl ether, ethyl vanillin, ethylene brassylate, eugenol, florocyclene, geraniol, geranium oil, geranyl acetate, 1,1,2,4,4,7-hexamethyl-6-acetyl-1,2,3,4-tetrahydronaphthalene, available under the trademark "TONALID", 1,3,4,6,7,8-hexahydro-4,6,6,7,8,8-hexamethylcyclopenta-2-benzopyran, available under the trade mark "GALAXOLIDE", 2-n-heptylcyclopentanone, 3a, 4,5,6,7,7a-hexahydro-4,7-methano-1(3)H-inden-6-ylpropionate, available under the trademark "FLOROCYCLENE", 3a4,5,6,7,7a-hexahydro-4,7-methano-1(3)H-inden-6-ylacetate, available under the trademark "JASMACYCLENE", 4-(4'-hydroxy-4'-methylpentyl)-3-cyclohexenecarbaldehyde, alpha-hexylcinammic aldehyde, heliotropin, hexyl aldone, hexyl cinnamic aldehyde, hexyl salicylate, hydroxycitronellal, i-nonyl formate, 3-isocamphylcyclohexanol, 4-isopropylcyclohexanol, 4-isopropylcyclohexyl methanol, indole, ionones, irones, isoamyl salicylate, isoborneol, isobornyl acetate, isobutyl salicylate, isobutylbenzoate, isobutylphenyl acetate, isoeugenol, isolongifolanone, isomethyl ionones, isononanol, isononyl acetate, isopulegol, lavandin oil, lemongrass oil, linalool, linalyl acetate, methyl beta orcinyl carboxylate (LRG 201), 1-menthol, 2-methyl-3-(p-isopropylphenyl)propanal, 2-methyl-3-(p-t-butylphenyl)propanal, 3-methyl-2-pentyl-cyclopentanone, 3-methyl-5-phenyl-pentanol, alpha and beta methyl naphthyl ketones, methyl ionones, methyl dihydrojasmonate, methyl naphthyl ether, methyl 4-propyl phenyl ether, Mousse de chene Yugo, Musk ambrette, myrtenol, neroli oil, nonanediol-1,3-diacetate, nonanol, nonanolide-1,4, nopol acetate, 1,2,3,4,5,6,7,8-octahydro-2,3,8,8-tetamethyl-2-acetyl-naphthalene, available under the trademark "ISO-E-SUPER", octol, Oppoponax resinoid, orange oil, p-t-amylcyclohexanone, p-t-butylmethylhydrocinnamic aldehyde, 2-phenylethanol, 2-phenylethyl acetate, 2-phenylpropanol, 3-phenylpropanol, para-menthan-7-ol, para-t-butylphenyl methyl ether, patchouli oil, pelargene, petitgrain oil, phenoxyethyl isobutyrate, phenylacetaldehyde diethyl acetal, phenylacetaldehyde dimethyl acetal, phenylethyl n-butyl ether, phenylethyl isoamyl ether, phenylethylphenyl acetate, pimento leaf oil, rose-d-oxide, Sandalone, styrallyl acetate, 1,1,4,4-tetramethyl-6-acetyl-7-ethyl-1,2,3,4-tetahydronaphthalene, available under the trademark "VERSALIDE", 3,3,5-trimethyl hexyl acetate, 3,5,5-trimethylcyclohexanol, terpineol, terpinyl acetate, tetrahydrogeraniol, tetrahydrolinalool, tetrahydromuguol, tetrahydromyrcenol, thyme oil, trichloromethylphenylcarbinyl acetate, tricyclodecenyl acetate, tricylodecenyl propionate, 10-undecen-1-al, gamma undecalactone, 10-undecen-1-ol, undecanol, vanillin, vetiverol, vetiveryl acetate, vetyvert oil, acetate and propionate esters of alcohol in the list above, aromatic nitromusk fragrances, indane musk fragrances, isochroman musk fragrances, macrocyclic ketones, macrolactone musk fragrances, and tetralin musk fragrances.

Further excipients which may be included in the perfume compositions of the present invention include various solvents, diluents or vehicles for other materials which are known for perfumery use and typically have a low odour or no odour. Examples of suitable solvents include benzyl alcohol, benzyl benzoate, dipropylene glycol, triacetin, Hecolyn D™, diethyl phthalate, triacetin, isopropyl myristate, triethyl citrate and acetyl tributyl citrate.

In an even further aspect the perfumes comprise compositions in which at least 20% by weight of the composition is constituted by perfume materials from both of the following categories:

a) perfumery nitrites of general formula RCN wherein R is a hydrocarbyl radical of formula CxHy, where 'x' is an integer in the range 10 to 12, and 'y' is an integer in the range 15 to 23;

b) perfumery hydrocarbons characterised by boiling points of less than 185° C. and octanol-water partition coefficients of at least 4.0 (logarithm base 10);

provided also that:

(i) the ratio of class a) ingredients to class b) ingredients lies within the range 10:1 to 1:2 (by weight);

(ii) the composition comprises less than 70% of materials that have boiling points of at least 250° C. and octol-water partition coefficients of at least 3.0 (logarithm base 10).

The compositions of the present invention can be used in or constitute a wide range of products. The invention in a fiber aspect therefore provides a product comprising a perfume composition in accordance with the invention.

Suitable products include, but are not limited to, products which provide a deodorant action when applied to the body e.g. deodorants and antiperspirants including different physical forms such as roll ons, gels, sticks, and aerosols; other personal products such as deocolognes, talcum powders, hand creams, lotions, skin and hair conditioners, sunscreens, soaps, shampoos, and shower gels; and laundry and household products such as laundry powders, laundry liquids, laundry tablets, rinse conditioners and fabric treatment products including fabric refresher products e.g. sprays, starch sprays, ironing sprays and stain remover sprays.

A preferred product is a laundry product and more particularly a laundry powder. Thus, in a preferred embodiment herein, the laundry product, particularly laundry powder, comprises between 0.01% to 10% and more preferably 0.1% to 1.0% by weight of the laundry product of a perfume composition in accordance with the present invention.

Perfume compositions in accordance with the present invention, in their simplest form as a fragrance, or as part of a product, may be applied to a surface including skin, hair, fabric etc, directly or indirectly. For example, when a perfume composition is part of a laundry product for washing fabric the composition may be applied to the fabric indirectly, i.e. via the wash liquor during the wash process.

The physical properties of the perfume materials of categories (a) and (b) are such that they are likely to rapidly evaporate from the surface they are applied to. The actual rate of evaporation is dependent upon a number of factors including the environmental conditions prevalent during application and following application e.g. temperature of the surface, the nature of the surface, and the presence and nature of other materials which may be delivered together with the fragrance during product treatment e.g. surfactant actives. Without wishing to be bound or limited by theory, it is thought that odour synergies between the nitrile perfumery material and hydrocarbon perfumery material may play a part in delivering efficient body malodour counteraction even at low residual levels.

Perfume compositions of the invention may also be incorporated into textiles directly during manufacture using techniques known in the art, to provide long lasting deodorant protection. It is also known in the art to carry or to encapsulate perfumes within other materials such as porous solids or polymeric matrices, in order to provide extended lifetimes, and to provide the possibility of triggered release, for example, during perspiration. Such techniques are applicable within the scope of the present invention.

In a further aspect, the invention provides a method of counteracting body malodour on a surface, by applying to the surface, a perfume composition in accordance with the present invention.

A perfume composition in accordance with the present invention counteracts body malodour on a surface, typically by reducing the perceived intensity of the body malodour evolved from the surface, or inhibiting or suppressing the olfactory detection of the evolution of body malodour from the surface when it comes into contact with body malodour, as appropriate.

In an even further aspect, the invention provides the use, as a deodorant, of a perfume composition in accordance with the present invention.

The invention is illustrated by the following examples.

All percentages are by weight unless otherwise indicated.

EXAMPLE 1

The following perfume, Perfume A, was prepared in accordance with the present invention and in the proportions indicated in Table 2 below:

TABLE 2

| Perfume A | | |
|---|---|---|
| Ingredient | w/w % | Category |
| alpha-Pinene | 5 | b |
| alpha-Terpineol | 9.5 | — |
| Benzyl benzoate | 5.0 | — |
| beta-Pinene | 5.0 | b |
| Camphene | 0.8 | b |
| Cineole | 1.0 | — |
| Dihydromyrcenol | 25.0 | — |
| Dodecanal (50% in DPG) | 1.0 | — |
| Geranyl nitrile | 15.0 | a |
| Lemongrass oil | 3.0 | — |
| Lilial | 0.5 | — |
| Linalol | 6.1 | — |
| Linalyl acetate | 9.2 | — |
| Litsea cubeba | 7.2 | — |
| Methyl chavicol | 1.0 | — |
| Octanal (50% in DPG) | 1.5 | — |
| Ortho-tert.-butylcyclohexanol | 0.7 | — |
| para-Cymene | 0.9 | b |
| para-tert-butyl cyclohexyl acetate | 0.3 | — |

Sum class (a) = 15.0%
Sum class (b) = 11.7%

Perfume A was tested for deodorant action in a laundry powder using the Malodour Reduction Value test as generally described in EP 545556. The results of this 5 hour deodorant test are given in Table 3, and demonstrate that Perfume A surprisingly provides significant deodorant action many hours after its application to cloth.

TABLE 3

| Results of 5 hr Malodour Reduction deodorant efficacy test | |
|---|---|
| Average panel score Perfume A | 2.28 |
| Control panel score | 3.23 |
| Malodour Reduction Value Perfume A | 0.95 |
| Malodour Reduction Value as percentage of control score | 29.4% |
| Difference for significance @ 99% = 0.23. | |

EXAMPLE 2

The Malodour Reduction Value test discussed above was repeated for Perfume A described in Example 1 above. Perfume A in this test was labelled Perfume 4500A.

Comparative testing was also carried out under the same conditions and using the same protocol with perfumes based on Perfume A, but modified to fall outside the scope of the invention. The comparative perfumes tested were as follows:

Perfume 4500B containing 50% of the amount of geranyl nitrile of Perfume A;

Perfume 4500D containing no nitrile perfumery material; and

Perfume 4500C containing 25% of the amount of hydrocarbon perfumery materials (category (b) materials) of Perfume A.

The results of the 5 hour deodorant test are given in Table 4.

TABLE 4

| Results of 5 hr Malodour Reduction deodorant efficacy test | |
|---|---|
| Average panel score Perfume 4500A | 2.48 |
| Average panel score Perfume 4500B | 2.57 |
| Average panel score Perfume 4500D | 2.59 |
| Average panel score Perfume 4500C | 2.65 |

It will be noted that the average panel score for Perfume 4500A is higher than for the test describe in Example 1. This is likely to use because of noise changes during test conditions (e.g. humidity, temperature etc.) which may affect deodorancy (from both the perspectives of malodour generation and malodour counteraction). Nevertheless, the results clearly show that Perfume 4500A (Perfume A) in accordance with the present invention demonstrates good deodorant action and that the modifications made to the formulation adversely affected deodorant action and efficacy.

The invention claimed is:

1. A perfume composition comprising:

a) unsaturated nitrile perfumery material of general formula RCN where R is a hydrocarbyl radical of formula CxHy, x is an integer in the range 9 to 12, and y is an integer in the range 15 to 25; and b) hydrocarbon perfumery material having a boiling point of less than about 185° C. and an octanol-water partition coefficient of at least 4.0 (in logarithmic form), wherein a) and b) together comprise at least 25% by weight of the total weight of the composition and wherein the weight ratio of a) to b) is in the range of 10:1 to 1:2, said composition being further characterized by its combination of fragrance and durable deodorant effect.

2. A perfume composition according to claim 1, wherein the weight ratio of nitrile perfumery material to hydrocarbon perfumery material is in the range 3:1 to 2:3.

3. A perfume composition according to claim 1, wherein the unsaturated nitrile perfumery material is 3-(2,4-dimethylcyclohex-3-enylidene) propanenitrile, 3,7-dimethyl-2,6-nonadienenitrile, citronellyl nitrile, 2-tridecenenitrile, 2-undecenenitrile, or geranylnitrile, and mixtures thereof.

4. A perfume composition according to claim 1, wherein the hydrocarbon perfumery material is a terpene.

5. A perfume composition according to claim 1, wherein the hydrocarbon perfumery material is camphene, p-cymene, limonene, myrcene, α-pinene, β-pinene, α-terpinene, β-terpinene, γ-terpinene or terpinolene, and mixtures thereof.

6. A perfume composition according to claim 1, wherein the perfume composition comprises less than 70% of perfumery materials having a boiling point of at least about 250° C. and an octanol-water partition coefficient of at least 3.0 (in logarithmic form).

7. A perfume composition according to claim 1, wherein x is an integer in the range 9 to 12, and y is an integer in the range 15 to 23.

8. A perfume composition according to claim 1, wherein x is 9 and y is 15, and the nitrile perfumery material is geranyl nitrile.

9. A perfume composition according to claim 8, wherein geranyl nitrile comprises at least 75% by weight of nitrile perfumery material.

10. A perfume composition according to claim 1, wherein the hydrocarbon perfumery material comprises a mixture of α-pinene and β-pinene.

11. A perfume composition according to claim 10, wherein α-pinene and β-pinene comprise at least 75% by weight of hydrocarbon perfumery material.

12. A product comprising a perfume composition in accordance with claim 1.

13. A laundry product comprising between 0.01% to 10% by weight of the laundry product of a perfume composition in accordance with claim 1.

14. A perfume composition according to claim 1 in which at least 25% by weight of the composition is constituted by perfume materials from both of the following categories:

a) unsaturated perfumery nitriles of general formula RCN wherein R is a hydrocarbyl radical of formula CxHy, where 'x' is an integer in the range 10 to 12, and 'y' is an integer in the range 15 to 23;

b) perfumery hydrocarbons characterised by boiling points of less than 185° C. and octanol-water partition coefficients of at least 3.0 (logarithm, base 10); provided also that:

(i) the ratio of class a) ingredients to class b) ingredients lies within the range 10:1 to 1:2 (by weight);

(ii) the composition comprises less than 70% of materials that have boiling points of at least 250° C. and octanol-water partition coefficients of at least 3.0 (logarithm base 10).

15. A method of counteracting body malodour which comprises applying to a surface of the body an effective amount of a perfume composition according to claim 1.

* * * * *